US007826632B2

(12) United States Patent
Von Buol et al.

(10) Patent No.: US 7,826,632 B2
(45) Date of Patent: Nov. 2, 2010

(54) METHOD OF ADJUSTING A HEARING INSTRUMENT

(75) Inventors: Andreas Von Buol, Zurich (CH); Andi Vonlanthen, Remetschwil (CH)

(73) Assignee: Phonak AG, Staefa (CH)

( * ) Notice: Subject to any disclaimer, the term of this patent is extended or adjusted under 35 U.S.C. 154(b) by 1126 days.

(21) Appl. No.: 11/462,148

(22) Filed: Aug. 3, 2006

(65) Prior Publication Data

US 2008/0031477 A1 Feb. 7, 2008

(51) Int. Cl.
*H04R 25/00* (2006.01)

(52) U.S. Cl. ..... 381/313; 381/328

(58) Field of Classification Search ..... 381/60, 381/95, 312, 313, 315, 328, 356
See application file for complete search history.

(56) References Cited

FOREIGN PATENT DOCUMENTS

EP 1221276 B1 7/2003

*Primary Examiner*—Brian Ensey
(74) *Attorney, Agent, or Firm*—Pearne & Gordon LLP

(57) ABSTRACT

The present invention provides a method of adjusting a hearing instrument that is at least partially insertable into an ear canal, the hearing instrument (1) comprising at least two microphones, the method comprising the steps of:

estimating the relative microphone location effect for each of the microphones;

estimating the feedback stability for each of the microphones;

determining the optimum proportion and phase of the signals of the microphones to be used in an omni-directional mode; and setting the optimum proportion and phase of the signals of the microphones.

Thus, the present invention takes into account the acoustical stability of each of the microphones in order to optimally combine the microphones to achieve an optimal omni-directional performance if desired by the user of the hearing instrument.

12 Claims, 1 Drawing Sheet

METHOD OF ADJUSTING A HEARING INSTRUMENT

TECHNICAL FIELD

This invention relates generally to a method of adjusting a hearing instrument.

BACKGROUND OF THE INVENTION

Hearing instruments, such as hearing devices or hearing aids, are often equipped with a multi-microphone system in order to provide directional information of the sound.

In such a directional mode of the hearing instrument, usually two microphones are located at the hearing instrument in a predefined distance from each other.

Especially for hearing devices of the type of in-the-ear (ITE) or completely-in-the-canal (CIC), there is only little space available for arranging the microphones. Even though, the two microphones, usually two electrically identical microphones, have a different acoustical behavior.

Especially the feedback stability and maximum stable gain are depending on the actual microphone location in relation to the venting of the hearing instrument housing, the pinna or other environmental influences caused by the physics of the user of the hearing instrument. Therefore, even if the distance between two technically identical microphones is very small, the feedback stability and maximum stable gain are different for those two microphones.

In EP 1 221 276, which is incorporated herein by reference, a method for adapting a hearing device and a hearing device with two microphones for directional-use is described. To allow the use of such a hearing device either in the left or the right ear of a user of this hearing device, the use of a switching unit to switch the connecting outputs of the microphones to the digital signal processing unit is proposed. Thus, the forward and backward location of the microphones within the hearing device in relation to the front of the head of the user may be adapted and thus the hearing device may be used either for the left or the right ear of the user, providing correct directional information.

Thus, this document teaches a predefined operational connection of multiple microphones to a digital signal processing unit.

In EP 1 309 225, which is incorporated herein by reference, a method for determining the feedback threshold of a microphone in a given location or position respectively within a hearing device and therefore the determination of the maximum gain for this microphone in a given acoustical setup is provided.

This method may be used for limiting the maximum gain for a specific microphone or to determine the value of the maximum gain for a specific microphone for providing feedback stability of the hearing instrument concerned.

It is an object of the present invention to provide a method of adjusting a hearing instrument with at least two microphones for the omni-directional mode.

SUMMARY OF THE INVENTION

The present invention provides a method of adjusting a hearing instrument, the hearing instrument comprising at least two microphones and an amplifying processing unit, the method comprising the steps of:

estimating the relative microphone location effect for each of the microphones;

estimating the feedback stability for each of the microphones;

determining the microphone with the better feedback stability to be used in an omni-directional mode.

For using the hearing instrument in an omni-directional mode, only the microphone determined to have the better feedback stability will be used, i.e. will be operationally connected to the amplifier or amplifying processing unit of the hearing instrument. Thus, a better performance rather then switching to a predetermined microphone will be achieved.

In a further embodiment of the present invention, the method further comprises the steps of:

determining the optimum proportion and phase of the signals of the microphones to be used in an omni-directional mode; and setting the optimum proportion and phase of the signals of the microphones.

This embodiment takes into account the acoustical stability of each of the microphones in order to optimally combine the microphones to achieve an optimal omni-directional performance if desired by the user of the hearing instrument. The known current solutions only propose the selection of one predetermined specific microphone, i.e. the microphone in the forward position of the shell of the hearing instrument, not taking into account the specific, individual acoustical stability of the microphones of a specific hearing instrument.

In a further embodiment, the determination of the optimum proportion and phase of the signals of the microphones will be made as a function of frequency and the optimum proportion and phase of the signals of the microphone will be set and modified accordingly. This takes into account that the microphones may have different acoustic performance for different frequencies. To provide excellent omni-directional performance, both microphones will remain active, but the optimum proportion an phase of the signals of the different microphones will be used dependent of the actual frequencies of the sound.

In a further embodiment, the relative microphone location effect is estimated by taking into account the different contributions of reflected sound by the pinna. The "microphone location effect" describes the amplification from free field sound to the microphone e.g. by reflections on the pinna. This effect may be measured directly for a certain range of frequencies for a specific hearing instrument inserted within the ear of the individual user of this hearing instrument. This may be performed either during the fitting process based on the real situation or based on stored geometrical data of the microphone location and the geometry of the pinna and the ear canal of the user retrieved during a customized shell molding process. This step is especially useful for hearing instruments of the type of ITE and CIC.

In a further embodiment, the feedback stability for each of the microphones is estimated by performing measurement on the ear of an individual user during the fitting process. Such a process is known and described for instance in EP 1 309 225, which is incorporated herein by reference.

In a further embodiment, the feedback stability for the microphones is estimated based on geometrical data of the location of the microphone and vent of the hearing instrument. Thus, the feedback stability will be calculated based on stored geometrical data of the hearing instrument and the geometry of the ear canal that may be recorded and stored during the molding process of the shell of a hearing instrument to be inserted into the ear canal.

In a further embodiment, the best microphone is determined and its location is selected as the only microphone to be used in an omni-directional mode. For the omni-directional mode, only one of the at least two microphones of the hearing instrument will be operationally connected to the amplifier or amplifying processing unit of the hearing instrument. This only one microphone is not a predefined microphone but the microphone with the better acoustic performance.

In a further embodiment, the best microphone is determined by weighting maximum stable overall amplifications as a function of frequency and selecting the most stable amplification. The maximum stable overall amplification is calculated as a function of frequency by adding the above described "microphone location effect" and the feedback threshold. The feedback threshold describes the maximum stable amplification of the hearing instrument from the microphone to the eardrum of the individual user of the hearing instrument.

In a further embodiment, the weighting is done by a predefined rule that is independent of individual hearing loss. Thus, the rule only takes into account the data retrieved by the hearing instrument itself and its position and influence by the geometry of the ear canal and the pinna.

In a further embodiment, the weighting is done by a predefined rule that is dependent of individual hearing loss. In addition to the data retrieved from the hearing instrument in its position within the ear of the user, the individual hearing loss of the user will be taken into account by the rule. This might be done for instance by estimating the feedback stability only for a specific range or multiple ranges of frequencies specified by the individual hearing loss of the user of the hearing instrument.

In a further embodiment, the selection of the better microphone position is done by switching the operative connection of the microphones to the previously determined better microphone, i.e. the microphone with the higher maximum stable overall amplification. This switching may be performed by using a switching unit within the hearing device to automatically connect only the better microphone to the amplifier or to the signal processing unit and/or to disconnect the other microphones respectively.

In a further embodiment of the present invention, the inventive method above will be applied to a hearing instrument that is at least partially insertable into an ear canal.

DESCRIPTION OF THE DRAWINGS

For purpose of facilitating and understanding of the invention, a preferred embodiment thereof is illustrated in the accompanying drawing to be considered in connection with the following description. Thus the invention may be readily understood and appreciated.

DESCRIPTION OF A PREFERRED EMBODIMENT

Figure 1:
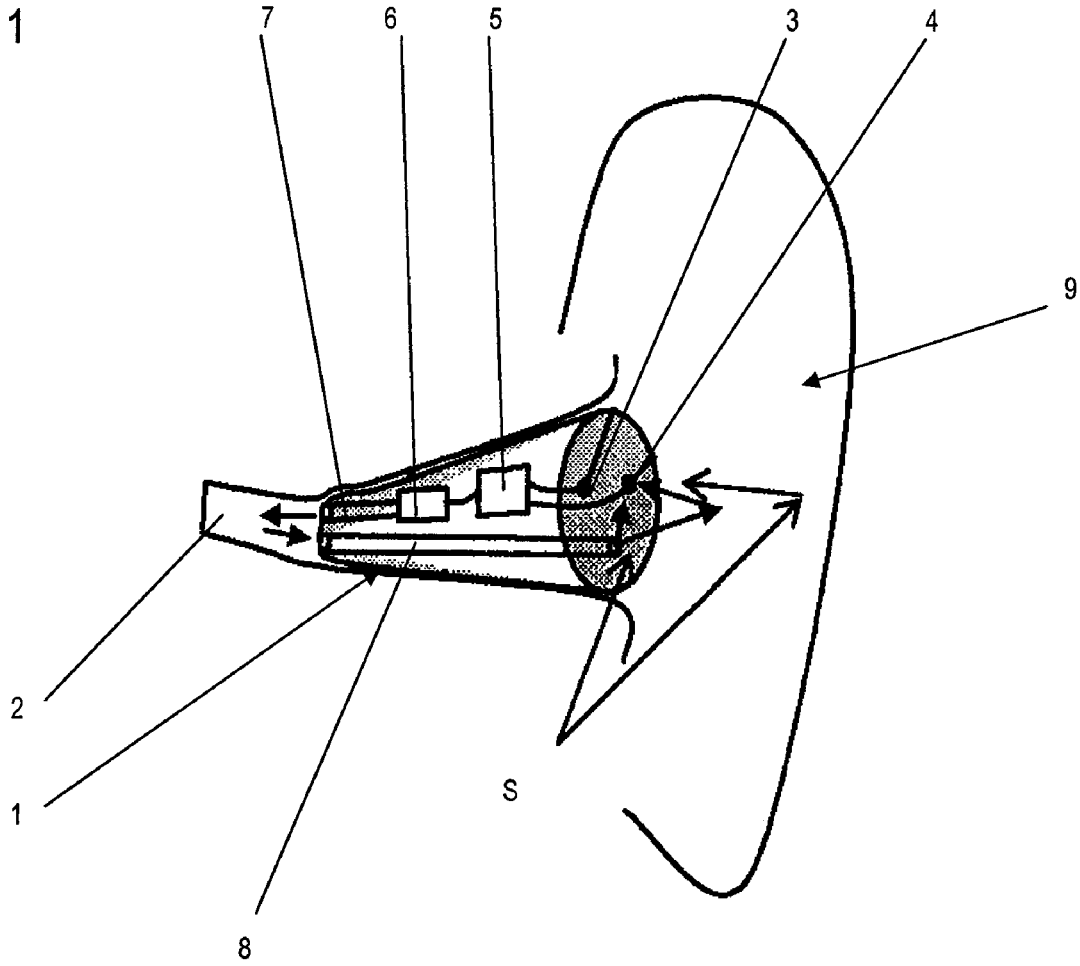
FIG. 1 schematically shows a partial cross-section of the external ear with a hearing instrument partially inserted into the ear canal.

Referring to FIG. 1, the schematic drawing of an ITE hearing aid 1 at least partially inserted into the ear canal 2 is shown. The hearing aid comprises two microphones 3 and 4, located on the front side of the shell of the hearing aid 1. Both microphones 3 and 4 are connected to an amplifying processing unit 5, arranged within the shell of the hearing aid 1. This amplifying processing unit 5 drives a receiver 6 which is acoustically coupled to the ear canal 2 via a conduit 7.

The hearing aid 1 further comprises a venting canal 8 that connects the ear canal 2 with the environment.

The influence of the pinna 9, surrounding the front side of the shell of the hearing aid 1, to the microphones 3 and 4 are shown by arrows symbolizing the path of the environmental sound S. This sound will arrive at the microphones both directly as well as reflected by the pinna 9.

If the user of the hearing aid 1 wants to switch from the regular directional use to the omni-directional use, in one embodiment, the better of the two microphones 3 and 4 remains connected to the amplifying processing unit 5 and the other microphone will be disconnected from the amplifying processing unit 5.

This switching is performed i.e. by using a switching unit as described in EP 1 221 276, which is incorporated herein by reference.

In another embodiment of the present invention, both microphones 3 and 4 remain connected to the amplifying processing unit 5. The amplifying processing unit 5 will set only one of those microphones active for determined ranges of frequencies, i.e. by applying respectively set filters. As an example it thus may be the case that the first microphone 3 is activated for low frequencies and the second microphone 4 is activated for high frequencies, providing an even better acoustic performance than using only one microphone for the whole range of frequencies.

The present solution advantageously takes the acoustical stability into account when combining the two microphones or selecting one of the two microphones for omni-directional use. Therefore the better microphone will be selected and thus a higher stable gain and less feedback related problems will be achieved for hearing devices with at least two microphones for the omni-directional mode.

What is claimed is:

1. Method of adjusting a hearing instrument, the hearing instrument comprising at least two microphones and an amplifying processing unit, the method comprising the steps of:

estimating the relative microphone location effect for each of the microphones;

estimating the feedback stability for each of the microphones;

determining the microphone with the better feedback stability to be used in an omni-directional mode.

2. The method of claim 1, comprising further the steps of:

determining the optimum proportion and phase of the signals of the microphones to be used in an omni-directional mode; and setting the optimum proportion and phase of the signals of the microphones.

3. The method of claim 2, wherein the determination of the optimum proportion and phase of the signals of the microphones will be made as a function of frequency and the optimum proportion and phase of the signals of the microphone will be set and modified accordingly.

4. The method of claim 1, wherein the relative microphone location effect is estimated by taking into account the different contributions of reflected sound by the pinna.

5. The method of claim 1, wherein the feedback stability for the microphones is estimated by performing measurements on the ear of an individual user during the fitting process of the hearing instrument.

6. The method of claim 1, wherein the feedback stability for the microphones is estimated based on geometrical data of the location of the microphones and vent of the hearing instrument.

7. The method of claim 1, wherein the best microphone is determined and is selected as the only microphone to be used in an omni-directional mode.

8. The method of claim 7, wherein the best microphone is determined by weighting maximum stable overall amplifications as a function of frequency and selecting the most stable amplification.

9. The method of claim 8, wherein the weighting is done by a predefined rule that is independent of individual hearing loss.

10. The method of claim 8, wherein the weighting is done by a predefined rule that is dependent on individual hearing loss.

11. The method of claim 7, wherein the selection of the better microphone is done by switching the operative connection of the microphones with the amplifying processing unit to the previously determined better microphone only.

12. Applying the method of any of claims 1 to 11 to a hearing instrument that is at least partially insertable into an ear canal.

* * * * *